US005141440A

United States Patent [19]

Wallingford

[11] Patent Number: 5,141,440

[45] Date of Patent: Aug. 25, 1992

[54] UNDERWATER BUOYANCY TRAINING OBSTACLE COURSE TARGET SET

[76] Inventor: Peter A. Wallingford, 236 S.W. 171 St.,, Seattle, Wash. 98166

[21] Appl. No.: 556,836

[22] Filed: Jul. 23, 1990

[51] Int. Cl.[5] ..... A63B 69/10; A63B 69/12; A63B 31/00; A63G 31/00

[52] U.S. Cl. ..... 434/254; 472/128; 482/55

[58] Field of Search ..... 434/254; 272/1 B, 71; 273/181 R; 441/1, 21, 24

[56] References Cited

U.S. PATENT DOCUMENTS

| | | | |
|---|---|---|---|
| 3,095,197 | 6/1963 | Weitzman | 273/102 |
| 3,323,795 | 6/1967 | Quello | 272/1 |
| 3,329,425 | 7/1967 | Gieseler | 272/1 |
| 3,332,166 | 7/1967 | Alexander | 46/220 |
| 3,499.647 | 3/1970 | Nestler | 272/1 |
| 3,794,322 | 2/1974 | Rosekrans, Jr. | 273/95 R |
| 3,826,494 | 7/1974 | Wainwright et al. | 273/1 R |
| 3,832,746 | 9/1974 | Korsgaard | 441/24 |
| 3,878,576 | 4/1975 | Suyderhoud | 9/8 R |
| 3,895,801 | 7/1975 | Baird | 273/95 R |
| 4,107,804 | 8/1978 | Bennett | 441/24 |
| 4,707,869 | 11/1987 | Ray | 4/505 |

FOREIGN PATENT DOCUMENTS

| | | | |
|---|---|---|---|
| 1185105 | 7/1959 | France | 441/1 |
| 1238614 | 7/1960 | France . | |

OTHER PUBLICATIONS

Leslie's Mail Order Presents, "Loops 'n Angles" One Page, Undated.

*Primary Examiner*—Gene Mancene
*Assistant Examiner*—Cindy A. Cherichetti
*Attorney, Agent, or Firm*—John R. Flanagan

[57] ABSTRACT

An underwater obstacle course kit for use in underwater buoyancy training includes a plurality of identical target sets. Each target set includes a target hoop, a line cord, and a line holder. The target hoop has a sealed interior for excluding water therefrom and for providing a buoyancy to the target hoop such that it is capable of undergoing upward floating movement toward a surface of a body of water. The line cord has one end portion attached to the target hoop and an opposite end portion being attachable to an object on a bottom of the body of water of sufficient weight to resist upward floating movement of the target hoop toward the body of water surface. The line holder is attached to the line cord and has a portion for receiving and storing a selected length of the line cord extending between its opposite end portions to provide the line cord with a desired overall length between the target hoop and the body of water bottom for maintaining the target loop floating at a desired height above the body of water bottom. Different underwater obstacle course layouts can be assembled using a plurality of target sets of the same course kit. They are slalom, escalator and roller-coaster obstacle course layouts.

14 Claims, 5 Drawing Sheets

UNDERWATER BUOYANCY TRAINING OBSTACLE COURSE TARGET SET

BACKGROUND OF THE INVENTION

1. Field of the Invention

The present invention generally relates to underwater diving training and, more particularly, is concerned with an underwater buoyancy training obstacle course target set, kit and layouts for use in promoting and establishing an underwater diving etiquette compatiable with marine environments.

2. Description of the Prior Art

Underwater diving, also known as scuba diving, has been a popular recreational sport for persons from many segments of the general public for a long time. It requires more skills than just the ability to swim underwater. Underwater diving requires the wearing and operating of relatively heavy and cumbersome equipment simultaneously as one controls body buoyancy level and coordinates the body movements necessary to move from from one depth to another. Skill in controlling body bouyancy is a prerequisite to being able to navigate safely and unintrusively near and over fragile underwater environments such as coral reefs.

As the popularity of underwater diving continues to grow, a primary problem faces the diving industry, namely, effective training of consistent buoyancy skills among sport divers. The present lack of consistency in this skill area affects diver safety and threatens the very existence of coral reefs at popular underwater diving destinations around the world. This lack of consistency has prevailed in the industry despite recognition that practice of buoyancy skills are essential as evidenced by the fact that limited training does take place. One training technique which has been used heretofore is for divers to swim through one or more buoyant circular hoops suspended off the bottom of a body of water by fixed-length weighted belts typically worn by divers.

What has made the training of consistent buoyancy skills a difficult problem in the past is the prevailing view that the particular skill level of a given certified underwater diver must be determined first. A diver will already possess certification documents evidencing completion of the necessary training to participate in underwater diving. However, buoyancy control skills decline the longer a diver remains inactive. Thus it is important to know how long ago it was that a given certified diver participated in underwater diving. There is no generally accepted and enforced logbook used in the diving industry, similar to what is used in the private flying industry, to show how frequently and recently a given diver participated in underwater diving. Testing or questioning every diver each time he or she prepares to engage in underwater diving creates ill-will and is not an effective nor workable solution.

As a consequence, a pressing need exists for a more systematic and non-confrontation approach to overcoming this difficult problem.

SUMMARY OF THE INVENTION

The present invention provides underwater buoyancy training obstacle course target set, kit and layouts designed to satisfy the aforementioned needs. Instead of attempting to determine each diver's particular buoyancy skill level by questioning the diver, the approach of the present invention is to provide a series of lightweight portable underwater obstacle course layouts over which divers can learn and practice effective underwater buoyancy techniques in a relatively short time. This approach can be used both with novice divers for increasing their skills and with more experienced divers for refreshing and renewing their skills without having to categorize each diver beforehand.

A certification card and logbook validation system can then be implemented to record and identify the buoyancy skill level of a given diver who has trained using the obstacle course layouts of the present invention. The use of the present invention by the diving industry will promote improved consistency in buoyancy training and skills and further the ultimate goal of establishing an underwater diving etiquette compatiable with fragile marine environments.

Accordingly, the present invention is directed to a target set, kit and layouts of an underwater obstacle course for use in underwater buoyancy training. The target set of the underwater obstacle course kit includes a target hoop, a line cord and a line holder.

The target hoop has a sealed interior for excluding water therefrom and providing a buoyancy to the target hoop such that the hoop is capable of undergoing upward floating movement toward a surface of a body of water. The line cord has one end portion attachable to the target hoop and an opposite end portion attachable to an object on the bottom of the body of water of sufficient weight to resist the upward floating movement of the target hoop toward the body of water surface.

The line holder is attachable to the line cord and has a portion for receiving and storing a selected length of the line cord extending between the opposite end portions thereof to provide the line core with a desired overall length between the target hoop and the body of water bottom for maintaining the target loop floating at a desired height above the body of water bottom.

The underwater obstacle course kit of the present invention for use in underwater buoyancy training is composed of a plurality of the identical target sets as defined above. The different underwater obstacle courses which can be assembled from the same course kit are slalom, escalator and rollercoaster course layouts.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
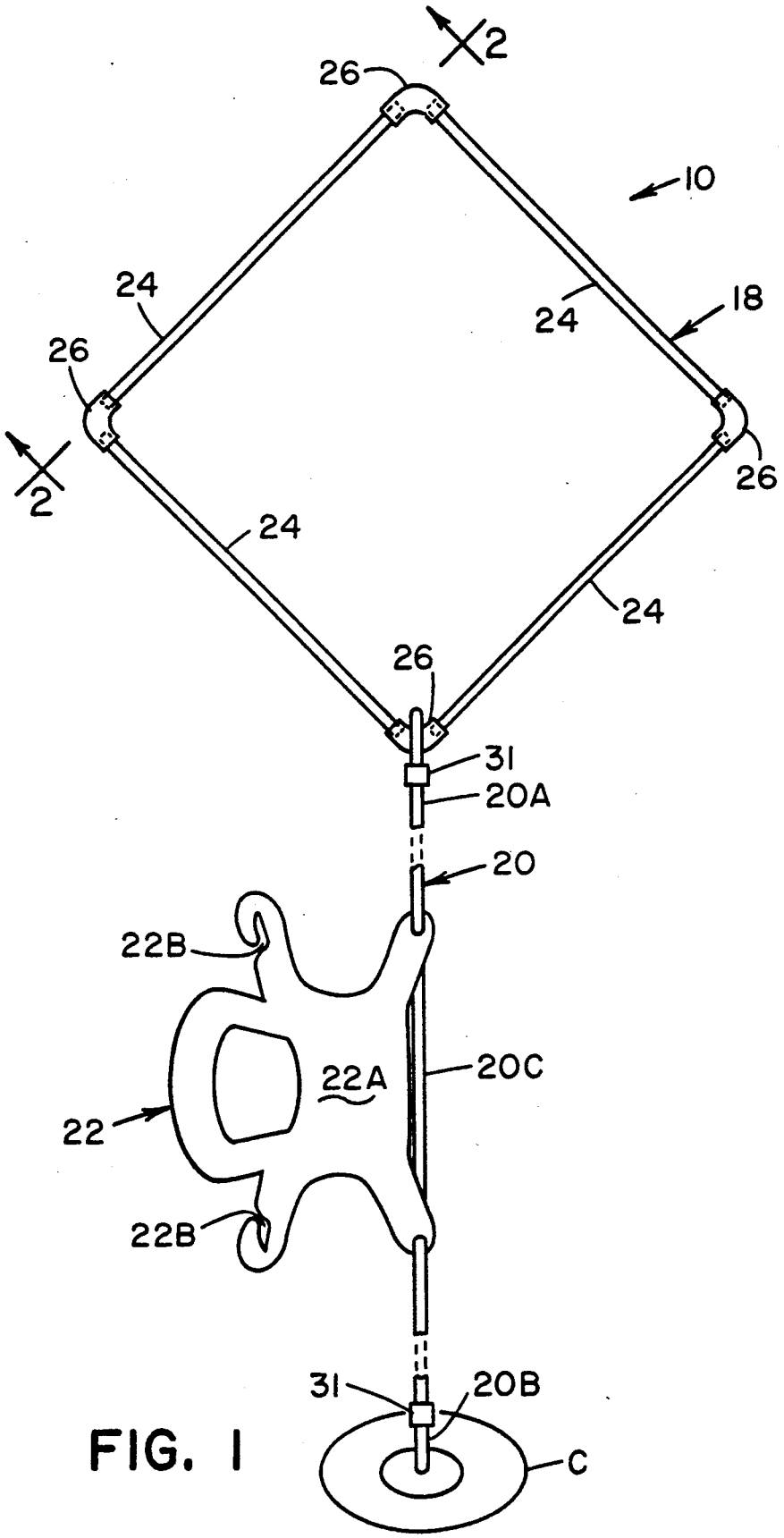
FIG. 1 is an end elevational view of one of a plurality of identical target sets composing an underwater buoyancy training obstacle course kit in accordance with the present invention, illustrating a preferred diamond-shaped hoop of the obstacle course kit target set.
Figure 2:
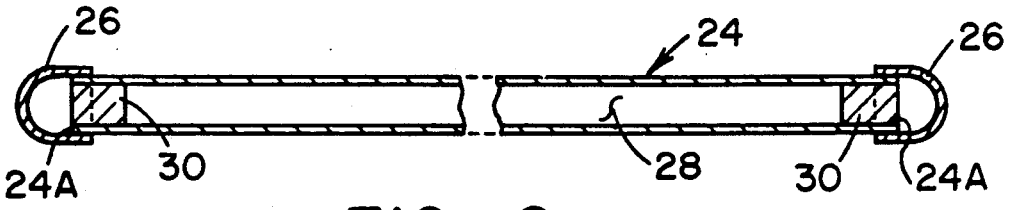
FIG. 2 is an enlarged foreshorted longitudinal sectional view taken along line 2—2 of FIG. 1 showing one of the tube members of the diamond hoop with a pair of elbow members of the hoop attached on opposite ends of the tubular member.
Figure 3:
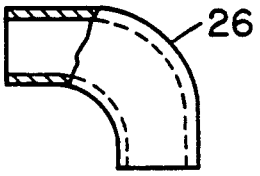
FIG. 3 is an enlarged side elevational view of one of the elbow members of the target set of FIG. 1.

Referring to the drawings, and particularly to FIGS. 1-4, there is shown an underwater obstacle course target set in accordance with the present invention, being generally designated 10. An underwater obstacle course kit for use in setting up different underwater buoyancy training obstacle course layouts (see FIGS. 15-17) in accordance with the principles of the present invention is comprised of a plurality of the target sets 10, for example five of such sets. The target sets 10 composing the obstacle course kit and used to set up each course layout are preferably identical to one another. As will be described in detail later, the different underwater course layouts which can be assembled by using the same course kit are the slalom course layout 12 of FIG. 15, the escalator course layout 14 of FIG. 16, and the rollercoaster course layout 16 of FIG. 17. These courses are set up and the buoyancy training which takes place using them is conducted, preferably, in an offshore region of relatively quiet, safe ocean water with little or no current and a minimum of fifteen to twenty feet of visibility. The recommended minimum depth of the body of water is thirty feet, allowing for a ten foot stop at the most shallow part of the obstacle course.

In its basic components, each target set 10 of the obstacle course kit includes a target hoop 18, a line cord 20, and a line holder 22. The target hoop 18 has a buoyancy sufficient to allow it to undergo upward floating movement toward a surface A of a body of water B, such a body of relatively quiet, safe ocean water. The line cord 20 can be any suitable flexible elongated tethering-type device having one end portion 20A adapted for attachment to the target hoop 18, an opposite end portion 20B adapted for attachment to an object C, such as a weight or rock, resting on a bottom D of the body of water B, and an intermediate portion 20C extending between opposite end portions 20A and 20B being attached to the line holder 22 and capable of being selective wrapped or wound about the line holder 22 to adjust the effective length of the line cord 20. The object C, which is not part of the present invention, must be able to anchor the target hoop 18 via line cord 20 and thus must have sufficient weight to resist the upward floating movement of the target hoop 18 toward the surface A of the body of water B. An object C, such as a lead weight, ranging from three to four pounds in weight is recommended.

The line holder 22 of the target set 10 is attached to the line cord 20 and has a portion 22A for receiving and storing a selected length of the intermediate portion 20C of the line cord 20 extending between the opposite end portions 20A, 20B thereof. The desired amount of line cord 20 can be stored on the line holder 22 by wrapping it about the storing portion 22A and then inserting and catching portions of the line cord 20 within tapered notches 22B in the line holder 22. In such manner, the line cord 20 is provided with a desired overall length from the bottom D of the body of water B to the target hoop 18 for maintaining the target loop 18 floating underwater at a desired height above the bottom D of the body of water B (or desired depth below the body of water surface A).

In the preferred embodiment of the target set 10 shown in FIG. 1, the target hoop 18 is of square- or diamond-shape configuration. The target hoop 18 is composed of a plurality of elongated straight hollow tubular members 24 having open opposite ends 24A, and a plurality of connecting corner members 26 interfitted with and attached to the opposite ends 24A of the tubular members 24. The straight tubular members 24 can be plastic tubes and the connecting members 26 can be right angle plastic elbows. The connecting members 26 can be attached to the straight tubular members 24 in any suitable manner such as by cementing them together.

Before assembling of the members 24, 26 together, hollow interiors 28 of the hollow tubular members 24 are sealed by insertion of plugs 30 into the open opposite ends 24A of the members 24 so as to capture air in the interior 28 and prevent water from entering for providing the desired buoyancy to the target hoop 18. The hollow tubular members 24 can be clear plastic tubes so that various forms of .light can be housed within the interiors 28 thereof to illuminate the hoop 18 for night and low visibility conditions.

Figure 4:
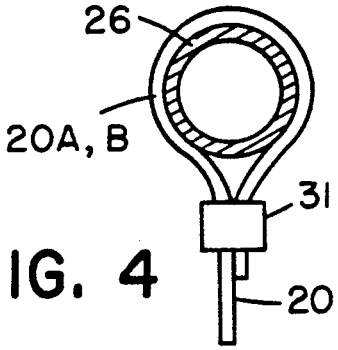
FIG. 4 is an enlarged fragmentary cross-sectional view showing the one elbow member of the diamond about which is attached a line cord of the target set of FIG. 1.
Figure 5:
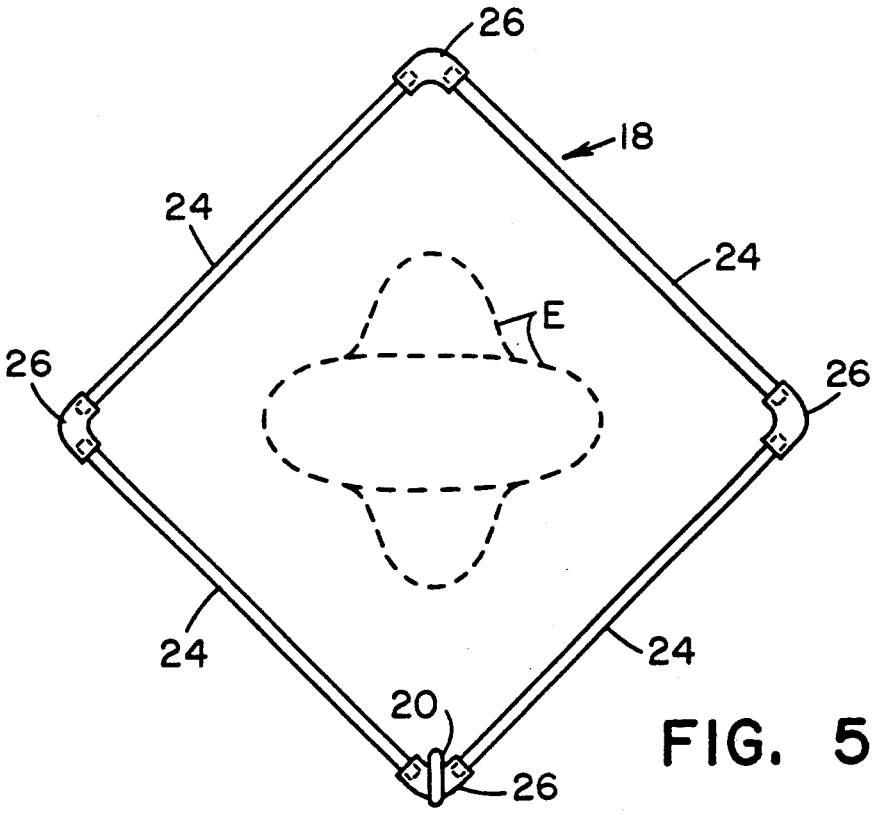
FIG. 5 is a diagrammatic view of a diver swimming through the diamond hoop of the target set of FIG. 1.

The one end portion 20A of the line cord 20 is attached to one of the connecting elbow members 26 of the target hoop 18 to dispose the hoop 18 in the diamond configuration as opposed to a square configuration relative to an outline E of a diver with equipment swimming through the hoop 18, as shown in FIG. 5. The opposite end portions 20A and 20B of the line cord 20 can be attached to the hoop 18 and object C in any suitable manner. Referring to FIGS. 1 and 4, an example of one way is by use of elastic bands 31 placed about the end portions 20A and 20B so as to provide loops at the end portions 20A and 20B of the line cord 20 which respectively encircle the one connecting elbow member 26 and a portion of the object C. Alternatively, the end portions 20A and 20 can be looped around the connecting member 26 and object C and then tied with suitable knots.

Figure 6:
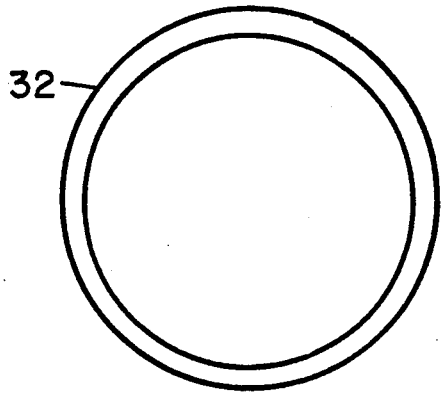
FIG. 6 is an end elevational view of an alternative circular hoop which can be substituted in place of the diamond hoop of the target set of FIG. 1.
Figure 7:
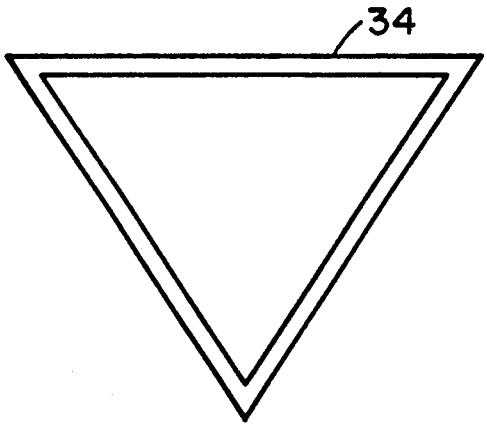
FIG. 7 is an end elevational view of an alternative triangular hoop which can be substituted in place of the diamond hoop of target set of FIG. 1.
Figure 8:
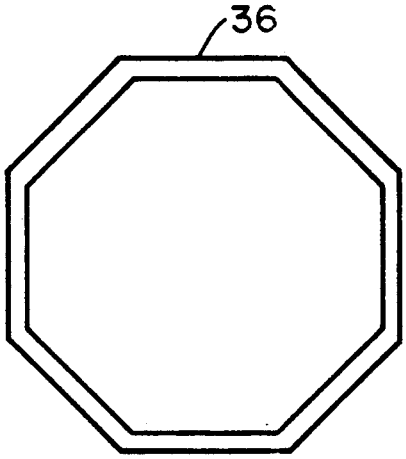
FIG. 8 is an end elevational view of an alternative octagonal hoop which can be substituted in place of the diamond hoop of the target set of FIG. 1.
Figure 9:
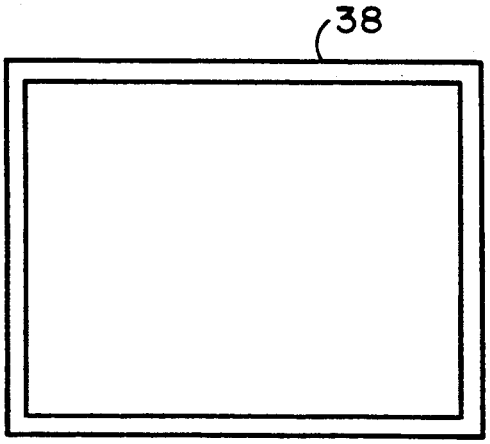
FIG. 9 is an end elevational view of an alternative rectangular hoop which can be substituted in place of the diamond hoop of the target set of FIG. 1.
Figure 10:
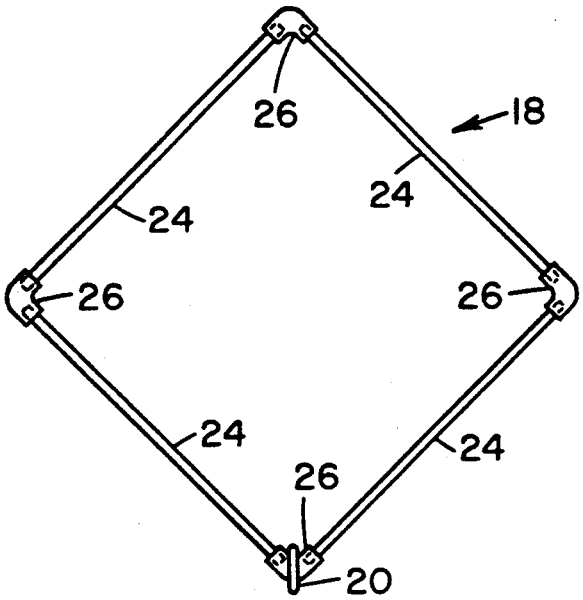
FIGS. 10 and 11 are end elevational views of a preferred construction of the diamond hoop of the target set of FIG. 1 illustrating a breakaway feature of the hoop in closed and opened conditions.

Referring to FIGS. 6–9, there is shown other possible configurations of the target hoop 18 of the target set 10 in accordance with the present invention. FIG. 6 illustrates a circular hoop 32. FIGS. 7–9 depict other possible polygonal shapes. For example, FIG. 7 illustrates a triangular hoop 34. FIG. 8 illustrates a octagonal hoop 36. FIG. 9 illustrates a rectangular hoop 38. As mentioned earlier, the diamond-shaped orientation of the target hoop 18 is preferred in view that it is the most efficient shape from the standpoint of the outline E of the diver plus the equipment worn by the diver passing through the hoop 18 generally matches the shape of the hoop as seen in FIG. 5. The diamond-shape of the hoop 18 also minimizes the amount and thus the weight of material required for an effective target. Furthermore, the diamond configuration has better underwater stability than the other configurations.

Referring to FIGS. 10–14, there is shown the target hoop 18 incorporating a breakaway feature 40 at the top of the hoop 18. The breakaway feature 40 is simply provided by not permanently attaching (e.g., not cementing) one end portion 24A of one of the upper tubular members 24 to the connecting elbow member 26. The unattached and merely interfitted or coupled one end portion 24A will pull away and become uncoupled from the elbow member 26 permitting the normally closed hoop 18 to open when a diver passing through the hoop 18 becomes entangled with the hoop 18 or starts to ascend before clearing the hoop.

Figure 14:
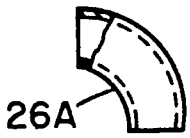
FIG. 14 is an enlarged side elevational view of a modified elbow member constituting a part of the breakaway feature of the hoops of FIGS. 11-14.
Figure 11:
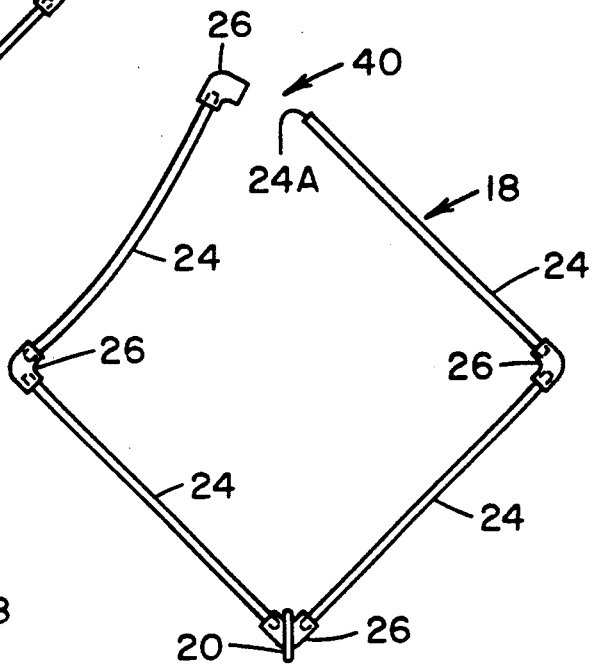
Figure 12:
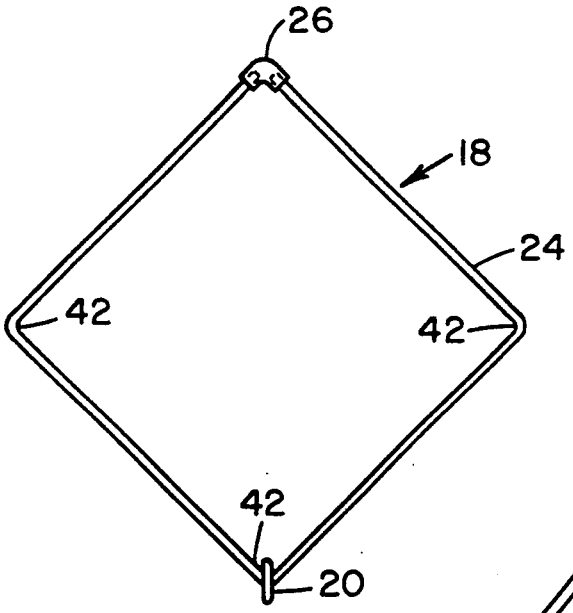
FIGS. 12 and 13 are end elevational views of a modified construction of the diamond hoop of the target set of FIG. 1 illustrating the breakaway feature of the hoop in closed and opened conditions.
Figure 13:
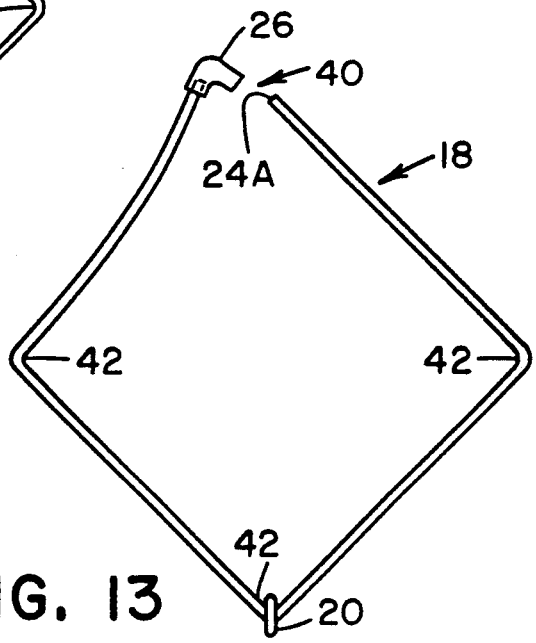

FIGS. 12 and 13 also illustrate an alternative construction of the target hoop 18 wherein only a single tubular member 24 and a single connecting elbow member 26 are employed. The single tubular member 24 is bent at 42 to form three of the corners of the diamond-shaped hoop 18 and the single elbow member 26 couples with the pair of opposite ends 24A and 24B of the tubular member 24 to form the fourth corner. At the fourth corner, only one of the ends 24B of the tubular member 24 is permanently attached to the elbow member 26 so as to provide the breakaway feature at the other end 24A. Referring to FIG. 14, a modified form of the connecting elbow member 26A can be employed to enhance the operation of the breakaway feature 40. One end 26B of the elbow member 26A is shortened to permit easier release and opening of the hoop 18 in response to pressure from the diver.

Figure 15:
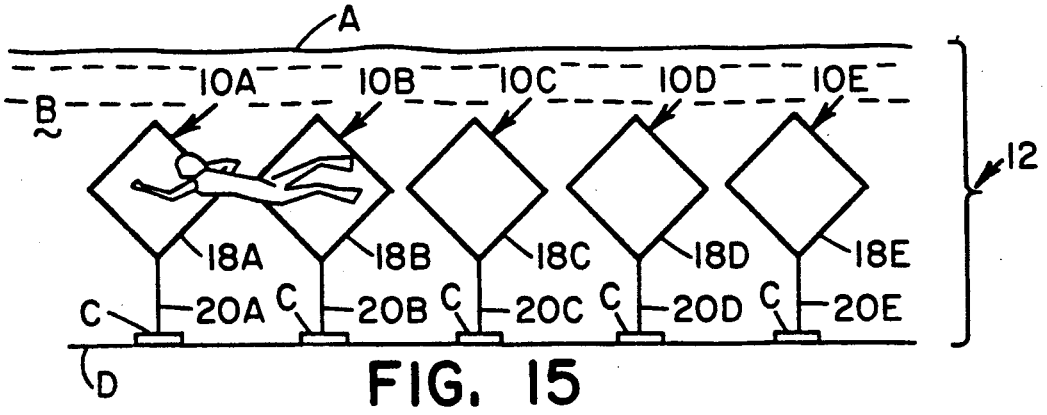
FIG. 15 is a schematical diagrammatic view of a slalom obstacle course layout for underwater buoyancy training in accordance with the present invention being constructed from the target sets of the obstacle course kit of FIG. 1.
Figure 16:
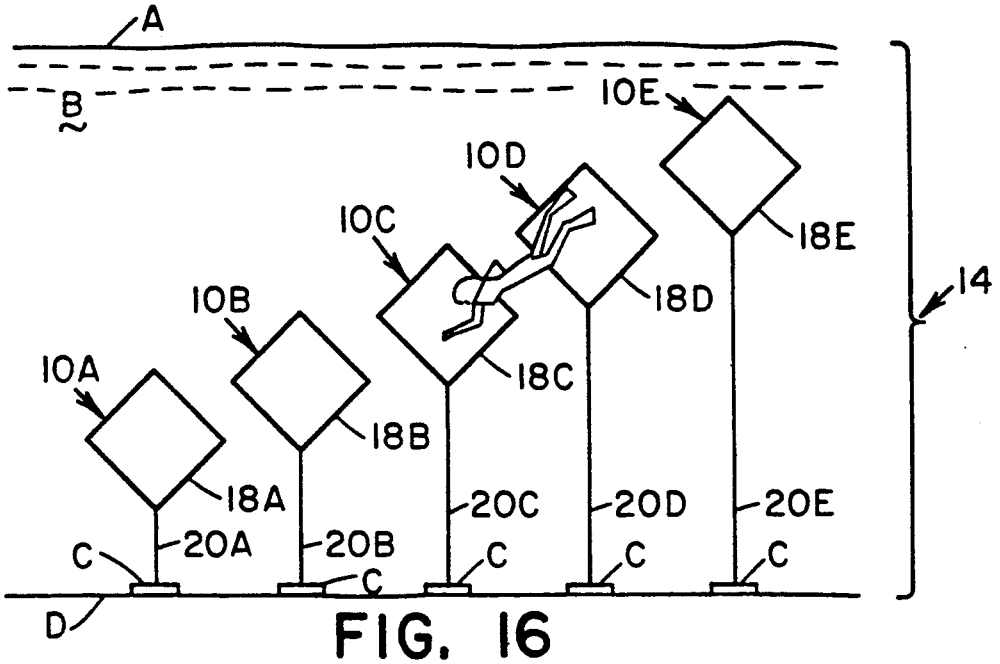
FIG. 16 is a schematical diagrammatic view of an underwater buoyancy training escalator obstacle course layout in accordance with the present invention also being constructed from the same target sets as the course layout of FIG. 15.
Figure 17:
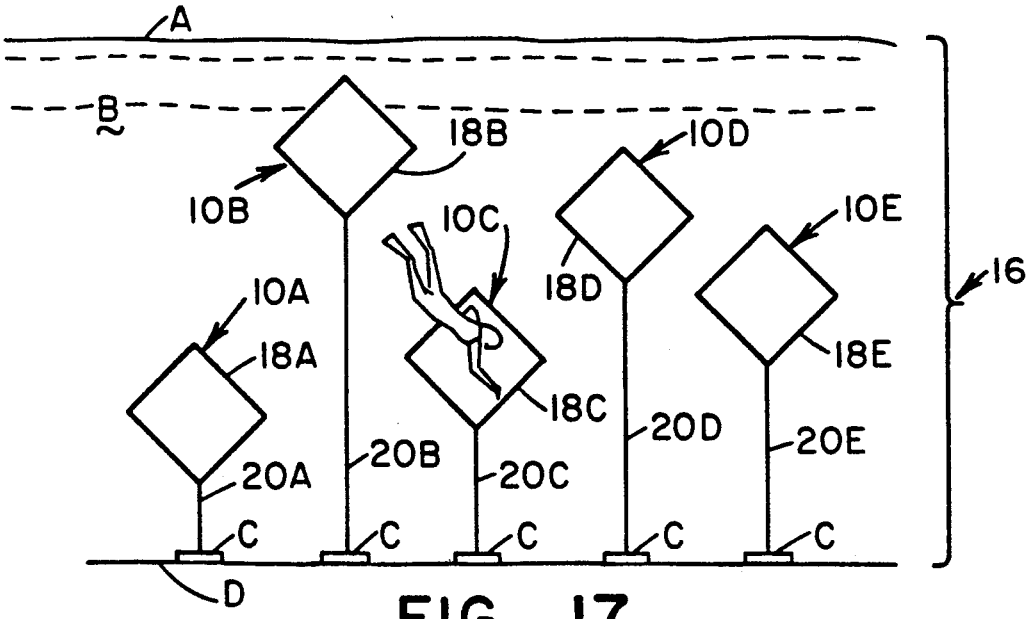
FIG. 17 is a schematical diagrammatic view of an underwater buoyancy training rollercoaster obstacle course layout in accordance with the present invention also being constructed from the same target sets as the course layout of FIGS. 15 and 16.

Referring to FIGS. 15–17, as briefly mentioned earlier, the different underwater course layouts of the present invention which are designed to improve the average diver's buoyance techniques are the slalom course layout 12 of FIG. 15, the escalator course layout 14 of FIG. 16, and the rollercoaster course layout 16 of FIG. 17. These course layouts can be assembled by using the five identical target sets 10 of the same course kit.

Referring to FIG. 15, the slalom course layout 12 is set up by arranging and aligning the five target sets 10A, 10B, 10C, 10D and 10E in a row and with the same lengths of the line cords 20A, 20B, 20C, 20D and 20E holding the target hoops 18A, 18B, 18C, 18D and 18E at the same depth underwater. Preferably, the hoops 18A–18E are maintained approximately nine feet apart and three feet above the bottom D of the body of water B. This layout is designed for practicing a commitment by divers to remain three feet above the bottom D which translates into the ability to stay at least three feet above coral reefs.

Referring to FIG. 16, the escalator course layout 14 is set up by arranging and aligning the five target sets 10A–10E in a row and adjusting the lengths of the line cords 20A–20E to increase progressively in length from the leftmost to rightmost target sets 10A–10E. Preferably, the hoops 18A–18E are maintained nine feet apart and respectively three, seven, eleven, fifteen and nineteen feet above the bottom D of the body of water B. This layout is designed for practicing gradual ascents and descents.

Finally, referring to FIG. 17, the rollercoaster course layout 16 is set up by rearranging the five target sets 10A–10E with their line cords 20A–20E having the lengths used in the escallator course layout 14 and aligning them in a row such that the successive target hoops 18A–18E are alternate in depth underwater from one to the next. This layout, being probably the most difficult of the three for divers, is designed for practicing controlled alternating ascents and descents.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. A target set of an underwater obstacle course kit for use in underwater buoyancy training, said target set comprising:

(a) a target hoop having connected portions and a sealed interior for excluding water therefrom and providing a buoyancy to said target hoop such that said hoop is capable of undergoing upward floating movement toward a surface of a body of water;

(b) a line cord having one end portion attachable to said target hoop and an opposite end portion attachable to an object on a bottom of the body of water of sufficient weight to resist the upward floating movement of said target hoop toward the body of water surface;

(c) a line holder attachable to said line cord and having a portion for receiving and storing a selected length of said line cord extending between said opposite end portions of said line cord to provide said line cord with a desired overall length between said target hoop and the body of water bottom for maintaining said target loop floating at a desired height above the body of water bottom; and (d) means for causing breakaway of said connected portions of said target hoop in response to force exerted thereon by a diver.

2. The target set of claim 1 wherein said target hoop is diamond-shaped.

3. The target set of claim 1 wherein said target hoop is circular-shaped.

4. The target set of claim 1 wherein said target hoop is polygonal-shaped.

5. The target set of claim 1 wherein said target hoop includes:

at least one elongated tubular member having opposite ends; and at least one connecting member coupled with said opposite ends of said one tubular member.

6. The target set of claim 5 wherein said one elongated tubular member contains a plurality of bends for defining different sides of said hoop.

7. The target set of claim 1 wherein said breakaway means is disposed on said target hoop opposite from the location where said one end portion of said line cord is attached to said target hoop.

8. An underwater obstacle course kit for use in underwater buoyancy training, said kit comprising:

(a) a plurality of target sets;

(b) each target set including (i) a buoyant target hoop capable of undergoing upward floating movement toward a surface of a body of water, said target hoop including a plurality of elongated tubular members having opposite ends and a plurality of connecting members coupled with said opposite ends of said tubular members, at least one of said connecting members and tubular members being releasably coupled together so as to provide a breakway feature permitting said hoop to open from a normally closed condition in response to entanglement of a diver with said hoop, (ii) a line cord having one end portion attachable to said target hoop and an opposite end portion attachable to an object on a bottom of the body of water for resisting upward floating movement of said target hoop toward the surface of the body of water, and (iii) a line holder attachable to said line cord and having a portion for receiving and storing a selected length of said line cord extending between said opposite end portions of said line cord to provide said line cord with a desired overall length between said target hoop and the body of water bottom for maintaining said target loop floating at a desired height above the body of water bottom.

9. The obstacle course kit of claim 8 wherein each of said target hoops of said target sets is diamond-shaped.

10. The obstacle course kit of claim 8 wherein said opposite ends of each of said tubular members are plugged so as to form said sealed interior of said each target hoop.

11. An underwater obstacle course for underwater buoyancy training, comprising:

(a) a plurality of target sets;

(b) each target set including (i) a buoyant target hoop capable of undergoing upward floating movement toward a surface of a body of water, (ii) a line cord having one end portion attached to said target hoop and an opposite end portion attached to an object on a bottom of the body of water for resisting upward floating movement of said target hoop toward the body of water surface, and (iii) a line holder attached to said line cord and having a portion for receiving and storing a selected length of said line cord extending between said opposite end portions of said line cord to provide said line cord with a desired overall length between said target hoop and the body of water bottom for maintaining said target loop floating at a desired height above the body of water bottom; and (c) said target sets being set up in a preselected arrangement defining said underwater obstacle course wherein said preselected arrangement of said target sets is an escalator course layout having said target sets aligned in a row with said line cords thereof increasing progressively in length from one to the next for holding said buoyant target hoops at decreasing depths underwater.

12. A target set of an underwater obstacle course kit for use in underwater buoyancy training, said target set comprising:

(a) a target hoop having a sealed interior for excluding water therefrom and providing a buoyancy to said target hoop such that said hoop is capable of undergoing upward floating movement toward a surface of a body of water, said target hoop including a plurality of elongated tubular members having opposite ends and a plurality of connecting members coupled with said opposite ends of said tubular members, at least one of said connecting members and tubular members being releasably coupled together so as to provide a breakway feature permitting said hoop to open from a normally closed condition in response to entanglement of a diver with said hoop;

(b) a line cord having one end portion attachable to said target hoop and an opposite end portion attachable to an object on a bottom of the body of water of sufficient weight to resist the upward floating movement of said target hoop toward the body of water surface; and (c) a line holder attachable to said line cord and having a portion for receiving and storing a selected length of said line cord extending between said opposite end portions of said line cord to provide said line cord with a desired overall length between said target hoop and the body of water bottom for maintaining said target hoop floating at a desired height above the body of water bottom.

13. The target set of claim 12 wherein said opposite ends of each of said tubular members is plugged so as to form said sealed interior of said target hoop.

14. An underwater obstacle course for underwater buoyancy training, comprising:

(a) a plurality of target sets;

(b) each target set including (i) a buoyant target hoop capable of undergoing upward floating movement toward a surface of a body of water, (ii) a line cord having one end portion attached to said target hoop and an opposite end portion attached to an object on a bottom of the body of water for resisting upward floating movement of said target hoop toward the body of water surface, and (iii) a line holder attached to said line cord and having a portion for receiving and storing a selected length of said line cord extending between said opposite end portions of said line cord to provide said line cord with a desired overall length between said target hoop and the body of water bottom for maintaining said target loop floating at a desired height above the body of water bottom; and (c) said target sets being set up in a preselected arrangement defining said underwater obstacle course wherein said preselected arrangement of said target sets is a rollercoaster course layout having said target sets aligned in a row with said line cords thereof alternately increasing and decreasing in length from one to the next for holding said buoyant target hoops at alternately decreasing and increasing depths underwater.

* * * * *